United States Patent [19]

Romeo et al.

[11] Patent Number: 4,973,419

[45] Date of Patent: Nov. 27, 1990

[54] HYDRATED ALKALI METAL PHOSPHATE AND SILICATED SALT COMPOSITIONS

[75] Inventors: Joseph Romeo, Bergenfield, N.J.; Anthony A. Rapisarda, Elmhurst, N.Y.

[73] Assignee: Lever Brothers Company, Division of Conopco, Inc., New York, N.Y.

[21] Appl. No.: 292,296

[22] Filed: Dec. 30, 1988

[51] Int. Cl.[5] ..... C11D 3/06; C11D 7/16; C11D 11/00

[52] U.S. Cl. ..... 252/135; 252/99; 252/174.14; 23/313 R; 23/313 AS; 23/313 FB

[58] Field of Search ..... 252/99, 135; 23/313 R, 23/313 AS

[56] References Cited

U.S. PATENT DOCUMENTS

| | | | |
|---|---|---|---|
| 3,248,330 | 4/1966 | Feirstein et al. | 252/99 |
| 3,306,858 | 2/1967 | Oberle | 252/99 |
| 3,359,207 | 12/1967 | Kaneko et al. | 252/99 |
| 3,494,868 | 2/1970 | Gray | 252/99 |
| 3,741,904 | 6/1973 | Christensen et al. | 252/99 |
| 3,812,045 | 5/1974 | Gray | 252/99 |
| 3,821,119 | 6/1974 | Temple | 252/135 |
| 3,933,670 | 1/1976 | Brill et al. | 252/99 |
| 4,182,683 | 1/1980 | Irvine et al. | 252/99 |
| 4,207,197 | 6/1980 | Davis et al. | 252/99 |
| 4,464,281 | 8/1984 | Rapisarda et al. | 252/174.21 |
| 4,587,031 | 5/1986 | Kruse et al. | 252/135 |

FOREIGN PATENT DOCUMENTS

| | | |
|---|---|---|
| 2822765 | 11/1978 | Fed. Rep. of Germany . |
| 2913145 | 10/1980 | Fed. Rep. of Germany . |
| 2478123 | 9/1981 | France . |

OTHER PUBLICATIONS

Article by E. J. Schuck & R. E. Temple entitled, "Silicated Sodium Carbonate as a Detergent Builder", Proc. Mid-Year Meeting, Chem., Spec. Manufact. Assoc., 1972, 58, 82–85,.

"Soaps/Cosmetics/Chemical Specialties," Aug. 1987.

*Primary Examiner*—Prince E. Willis

*Attorney, Agent, or Firm*—Ronald A. Koatz

[57] ABSTRACT

Compositions suitable for use as detergents comprise a non-silicate-coated alkali metal phosphate salt hydrated to at least about 50% by weight, and an inorganic salt selected from alkali metal carbonates and sulfates. The compositions for use in, e.g. dishwashing, have improved solubility and dispersion characteristics.

45 Claims, No Drawings

HYDRATED ALKALI METAL PHOSPHATE AND SILICATED SALT COMPOSITIONS

BACKGROUND OF THE INVENTION

Automatic dishwashing detergent powders typically include substantial amounts of inorganic phosphates, which provide alkalinity and sequester calcium ions. Another important ingredient in powdered autodish detergents is silicate, which functions to prevent corrosion and protect overglaze. It is generally preferred to use liquid silicate solution as the silicate source in such compositions since it tends to be less expensive and is a good agglomerating agent.

There are various types of processes for manufacturing powdered detergent compositions. Among these may be mentioned spray drying, agglomerating, dry blending and hybrids thereof. The manufacture of automatic dishwashing detergents primarily involves agglomeration or dry blending. Agglomeration processes for preparing automatic dishwashing detergents frequently involve spraying the liquid silicates onto mixtures consisting mainly of dry salt ingredients such as sodium tripolyphosphate, chlorinated trisodium phosphate, sodium carbonate, sodium sulfate, sodium chloride, etc.

It is frequently difficult to load the desired amount of liquid silicate onto the salts to be used in the composition. One reason for this is that it may be desirable that the phosphates be prehydrated since phosphates lacking moisture tend to cake in the dishwasher's dispenser cup. In such cases, the presence of water in the phosphates limits the amount of silicate which can be absorbed. The difficulty in loading silicates onto hydrated phosphates tends to result in an uneven distribution of size and formation of fines which give the product an undesirable particle size distribution. In addition, agglomerated products have a tendency to cake in the dispenser cup.

An article by E. J. Schuck and R. E. Temple entitled "Silicated Sodium Carbonate As A Detergent Builder," Proc. Mid-Year Meet., Chem. Spec. Manufac. Assoc. 1972, 58, 82–85 discloses silicated soda ash builders in automatic dishwashing detergents including tripolyphosphate. An example discloses silicated soda ash having a moisture level of 4%. It is not stated that the tripolyphosphate is hydrated. The silicated sodium carbonate is said to give acceptable solubility and good open storage stability.

"Soap/Cosmetics/Chemical Specialties," August, 1987, page 89 discloses a process for making a free-flowing granular non-phosphate machine dishwashing detergent. The process begins by spraying a mixture of surfactant, water and liquid silicate onto soda ash, after which sodium metasilicate is added and mixed continuously.

Temple, U.S. Pat. No. 3,821,119 discloses a method of preparing a particulate detergent builder which includes admixing liquid sodium silicate with anhydrous soda ash, passing the resultant granules through a screen and rapidly heating the screened material to a temperature in excess of 100° C.

SUMMARY OF THE INVENTION

The first embodiment of the present invention is directed to the discovery that certain levels of phosphate hydration are important in compositions which include silicated sodium carbonate and particular phosphate salts. The first embodiment, therefore, includes compositions comprising alkali metal tripolyphosphate salts hydrated to a specified level and silicated sodium carbonate and/or silicated mixtures of sodium carbonate with sodium sulfate and to a process for preparing such compositions.

In particular, the first embodiment relates to compositions, suitable for use as automatic dishwashing detergents, laundry detergents and for other purposes, which comprise a non-silicate-coated alkali metal tripolyphosphate salt hydrated to at least about 50% by weight, an inorganic salt selected from the group consisting of (i) alkali metal carbonate and mixtures of alkali metal carbonate and alkali metal sulfate wherein the inorganic salt is admixed with alkali metal silicate. It has been found that when such compositions are utilized as or in automatic dishwashing formulations, there is improved solubility and less tendency to cake in the dispenser cup. The hydrated phosphate may even be used without the silicated nonphosphorus salt.

The process of the first aspect of the invention involves mixing together the separately prepared or obtained hydrated phosphate and silicated alkali metal salt. The silicate is more completely loaded onto the alkali metal salt than is the case when it is sprayed onto mixtures including phosphate salts. Moreover, the process effects a substantial savings over those wherein the phosphate is hydrated together with other salts in that excess water is generally used and absorbed by the other salts. Consequently, these processes require extensive drying operations to remove the excess water.

It has also been discovered that when silicated alkali metal carbonate or mixtures thereof with other nonphosphate alkali metal salts are prepared under specified conditions and/or possess a particular level of moisture, such agglomerates have improved characteristics for use in automatic dishwashing detergent and other formulations. In accordance with this second embodiment of the invention, the silicated soda ash is conditioned by exposing the silicated salt to hot air so that the silicated salt attains a temperature in the range of 120° to 150° F. Conditioning times range from 5 to 25 minutes. It has also been found to be advantageous for the silicated alkali metal inorganic salt to have a moisture level of at least 5% by weight, preferably 6%, and especially at least 7.5%. Preferably, the moisture level does not exceed 12% by weight. Therefore, these second aspects of the invention include processes for preparing silicated salts, silicated salts prepared by the processes and silicated salts having the requisite moisture levels. The fluidized bed-treated powder must attain within 5 to 25 minutes, a temperature of at least 120° F. and the temperature must not exceed 150° F. before removal from the fluidized bed.

In an especially preferred embodiment of the invention, the first two embodiments are combined such that phosphate having the preferred levels of hydration are utilized together with the preferred silicated salts of the second embodiment.

DETAILED DESCRIPTION OF THE INVENTION

The compositions of the present invention preferably take the form of automatic dishwashing detergents and processes for their preparation, but may take the form of other types of formulations including laundry detergent and other classes of compositions.

Automatic dishwashing compositions according to the invention will typically include an alkali metal inorganic phosphate builder salt which has not been sprayed or otherwise admixed with silicate and when the builder is sodium tripolyphosphate, it is preferably hydrated in accordance with the first aspect of the invention. The level of hydration of sodium tripolyphosphate is preferably at least 50% by weight, more preferably at least 60% and even more preferably at least 75%.

Total hydrated phosphate builder salt levels in automatic dishwashing compositions according to the invention will typically range up to about 90%, preferably from 10 to 70%, still preferably from 20 to 60% by weight. Suitable phosphate builder salts include trisodium phosphate, tetrasodium pyrophosphate, sodium acid pyrophosphate, sodium tripolyphosphate hexahydrate, sodium monobasic phosphate, sodium dibasic phosphate and sodium hexametaphosphate or mixtures thereof. The potassium, lithium, ammonium, methylammonium, diethanolammonium, triethanolammonium, other substituted ammonium, mono-, di- and triethanolamine, methylamine, other amine salts and mixtures thereof may be used as well. Of course, if chlorine bleach is used, ammonium and amine-containing compounds should be avoided.

In accordance with the second embodiment of the invention, automatic dishwashing compositions preferably include up to 80%, preferably from 5 to 60%, especially 10 to 50% by weight of a silicated alkali metal or ammonium or substituted ammonium inorganic, non-phosphorus salt. Preferably the salt is alkali metal or ammonium carbonate, bicarbonate or sesquicarbonate or mixtures thereof or a mixture thereof with other alkali metal inorganic salts such as sulfate. The weight ratio of alkali metal carbonate, bicarbonate or sesquicarbonate or mixtures thereof to alkali metal sulfate or other inorganic salt or mixtures thereof is from 10:1 to 1:10, preferably 5:1 to 1:5. Other inorganic, non-phosphorus salts include borax, and limited amounts of alkali metal or ammonium chloride and and mixtures thereof. From 10 to 50% by weight of non-silicated inorganic, non-phosphorus salts including crystalline and amorphous aluminosilicates, solid silicates and salts mentioned above may be included as well. Preferably, the silicated non-phosphate salt is conditioned to provide about 40 to 70% loss of silicate moisture. The product density is preferably in the range of 40–50 lbs/cu ft., especially about 47 lbs/cu ft. Generally, the salt is "silicated" by spraying with an aqueous silicate solution and agglomerated.

Compositions including silicated inorganic salt in accordance with the second aspects of the invention preferably also include alkali metal inorganic phosphate according to the first aspect of the invention. The hydration level of the phosphate is most significant when the ratio of silicated inorganic salt to non-silicate-coated alkali metal inorganic phosphate is not greater than 70:30, particularly not greater than 60:40 and especially not greater than 55:45.

The compositions of this invention generally contain sodium or potassium silicate. This material is employed as a cleaning ingredient, source of alkalinity, metal corrosion inhibitor and protector of glaze on china tableware. Especially effective is sodium silicate having a ratio of $SiO_2$:$Na_2O$ of from about 1.0 to about 3.3, preferably from about 2 to about 3.2.

The non-phosphate inorganic salt which is to be sprayed with silicate preferably is of a size such that a maximum of 53% is held on a U.S. 60 mesh.

Automatic dishwashing detergents according to the invention may also include organic builders, preferably at a level of from 0.5 to 30%. These may include water-soluble, i.e., sodium, potassium, ammonium salts of aminopolycarboxylic acids and hydroxycarboxylic acids and mixtures thereof. The acid portion of the salt may be derived from acids such as nitrilotriacetic acid (NTA), N-(2-hydroxyethyl) nitrilodiacetic acid, nitrilodiacetic acid, ethylenediaminetetraacetic acid (EDTA), N-(2-hydroxyethyl) ethylenediamine triacetic acid, 2-hydroxyethyliminodiacetic acid, diethylenetriamine pentaacetic acid, citric acid, etc., and mixtures thereof. Polyacrylate builders and polyacetal carboxylates such as those described in U.S. Pat. Nos. 4,144,226 and 4,146,495 may also be used.

Other useful organic detergent builders include sodium and potassium salts of the following: phytates, polyphosphonates, oxydisuccinates, oxydiacetates, carboxymethyloxy succinates, tetracarboxylates, starch and oxidized heteropolymeric polysaccharides.

A wide variety of bleaching agents may be employed for use with these detergent powders. Both halogen and peroxygen type bleaches are encompassed by this invention.

Among the suitable halogen donor bleaches are heterocyclic N-bromo and N-chloro imides such as trichlorocyanuric, tribromocyanuric, dibromo- and dichlorocyanuric acids, and salts thereof with water-solubiling cations such as potassium and sodium. An example of the hydrated dichlorocyanuric acid is Clearon CDB56, a product manufactured by the FMC Corporation. Such bleaching agents may be employed in admixtures comprising two or more distinct chlorine donors. An example of a commercial mixed system is one available from the Monsanto Chemical Company under the trademark designation "ACL-66" (ACL signifying "available chlorine" and the numerical designation "66", indicating the parts per pound of available chlorine) which comprises a mixture of potassium dichloroisocyanurate (4 parts) and trichloroisocyanurate acid (1 part).

Other N-bromo and N-chloro imides may also be used such as N-brominated and N-chlorinated succinimide, malonimide, phthalimide and naphthalimide. Other compounds include the hydantoins, such as 1, 3-dibromo and 1,3-dichloro-5,5-dimehtylhydantoin, N-monochloro-C, C-dimentylhydantoin methylene-bis(N-bromo-C,C-dimethylhydantoin); 1,3-dibromo and 1,3-dichloro 5,5-isobutylhydantoin; 1,3-dibromo and 1,3-dichloro 5-methyl-5-n-amylhydantoin, and the like. Further useful hypohalite liberating agents comprise tribromomelamine and trichloromelamine.

Dry, particulate, water-soluble anhydrous inorganic salts are likewise suitable for use herein such as lithium, sodium or calcium hypochlorite and hypobromite.

The hypohalite liberating agent, may, if desired, be provided in a form of a stable solid complex or hydrate. Examples include sodium p-toluene-sulfo-bromoamine-trihydrate, sodium benzene-sulfo-chloroamine-dihydrate, calcium hypobromite tetrahydrate, calcium hypochlorite tetrahydrate, etc. Brominated and chlorinated trisodium phosphate formed by the reaction of the corresponding sodium hypohalite solution with trisodium phosphate (and water if necessary) likewise comprise efficacious materials.

Preferred chlorinating agents include potassium and sodium dichloroisocyanurate dihydrate, chlorinated trisodium phosphate and calcium hypochlorite. Particularly preferred are sodium or potassium dichloroisocyanurate dihydrate. Preferred concentrations of all of these materials should be such that they provide about 0.2 to about 1.5% available chlorine. Hypohalite liberating compounds may generally be employed in automatic dishwashing detergents at a level of from 0.5 to 5% by weight, preferably from 0.5 to 3%.

Suitable chlorine-releasing agents are also disclosed in the ACS monograph entitled "Chlorine—Its Manufacture, Properties and Uses" by Sconce, published by Reinhold in 1962. This book is incorporated by reference.

Among the oxygen bleaches which may be included in the invention are alkali metal and ammonium salts of inorganic peroxygen compounds such as perborates, percarbonates, persulfates, dipersulfates and the like. Generally the inorganic oxygen compound will be used in conjunction with an activator such as TAED (tetraacetyl ethylene diamine), sodium benzoyl oxybenzene sulfonate or choline sulfophenyl carbonate or a catalyst such as manganese or other transition metal, as is well known in the bleaching art. Insoluble organic peroxides such as diperoxydodecanedioic acid (DPDA) or lauroyl peroxide may also be used. Generally, the peroxygen compounds are present at a level of from 0.5 to 20% by weight, 0.005 to 5% catalyst and 1 or 0.5 to 30% activator.

The pH of automatic dishwashing compositions in accordance with the invention preferably ranges from 9 to 12, especially from 10 to 11. In general, the alkalinity of the composition is adjusted by varying the levels of alkaline builder salt.

Water-soluble organic detergents may be included in the automatic dishwashing compositions according to the invention. They may be included in liquids sprayed onto the inorganic salt or in the water used to hydrate the phosphate or may otherwise be added to the compositions. It is not necessary that the liquid silicate sprayed onto the sodium carbonate or other nonphosphate, inorganic salt in the process of the invention include any surfactant. If surfactant is included in one or more liquids to be sprayed onto the inorganic salt, it may be present either together with the silicate in the silicate solution or sprayed on separately.

Generally, the water-soluble organic detergents will be included at a level of from 0 to 15% by weight, preferably 0.5 to 5%, especially from 1 to 3%. The detergent may be anionic, nonionic, cationic, zwitterionic, amphoteric or mixtures thereof. Low-foaming, nonionic surfactants are preferred.

Nonionic surfactants include those detergent compounds which contain an organic hydrophobic group and a hydrophilic group which is a reaction product of a solubilizing group such as carboxylate, hydroxyl, amido or amino with ethylene oxide or propylene oxide or with a polyhydration product thereof such as polyethylene glycol.

Nonionic synthetic detergents can be broadly defined as compounds produced by the condensation of alkylene oxide groups with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative but not limiting examples of the various chemical types suitable as nonionic surfactants include:

(a) polyoxyethylene and/or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of about 12 carbon atoms, "tallow" fatty acids (derived from tallow-class fats) which contain a myristic acid, stearic acid and lauric acid.

(b) polyoxyethylene and/or polyoxypropylene condensates of aliphatic alcohols, whether linear- or branched-chain and unsaturated or saturated, containing from about 6 to about 24 carbon atoms and incorporating from about 5 to about 50 ethylene oxide or propylene oxide units. Suitable alcohols include the "coconut" fatty alcohol, "tallow" fatty alcohol, lauryl alcohol, myristyl alcohol and oleyl alcohol. Particularly preferred nonionic surfactant compounds in this category are the "Neodol" type products, a registered trademark of the Shell Chemical Company.

Included within this category are nonionic surfactants having the formula:

$$RO-(CH_2\underset{\underset{R'}{|}}{C}HO)_x(CH_2CH_2O)_y(CH_2\underset{\underset{R''}{|}}{C}HO)_z-H$$

wherein R is a linear, alkyl hydrocarbon having an average of 6 to 10 carbon atoms, R′ and R″ are each linear alkylhydrocarbons of about 1 to 4 carbon atoms, x is an integer from 1 to 6, y is an integer from 4 to 15 and z is an integer from 4 to 25. A particularly preferred example of this category is sold under the registered trademark of Poly-Tergent SLF-18 by the Olin Corporation, New Haven, Conn. Poly-Tergent SLF-18 has a composition of the above formula where R is a $C_6$–$C_{10}$ linear alkyl mixture, R′ and R″ are methyl, x averages 3, y averages 12 and z averages 16. Another surfactant from this category has the formula $$C_{8-10}O(CH_2CH_2O)_{7.81}(CH_2\underset{\underset{CH_3}{|}}{C}HO)H_{14.45}$$

(c) polyoxyethylene or polyoxypropylene condensates or alkyl phenols, whether linear-or branched-chain and unsaturated or saturated, containing from about 6 to about 12 carbon atoms and incorporating from about 5 to about 25 moles of ethylene oxide or propylene oxide.

(d) polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tristearate, sorbitan monooleate, and sorbitan trioleate. The polyoxyethylene chains may contain between about 4 and 30 ethylene oxide units, preferably about 20. The sorbitan ester derivatives contain 1, 2 or 3 polyoxyethylene chains dependent upon whether they are mono-, di-, or tri-acid esters.

(e) polyoxyethylene-polyoxypropylene block polymers having the formula:

$$HO(CH_2CH_2O)_a(CH(CH_3)CH_2)_b(CH_2CH_2O)_cH$$

wherein a, b and c are integers reflecting the respective polyethylene oxide and polypropylene oxide blocks of said polymer. The polyoxyethylene component of the block polymer constitutes at least about 40% of the block polymer. The material preferably has a molecular weight of between about 2,000 and 10,000, more preferably from about 3,000 to about 6,000. These materials are well known in the art. They are available under the trademark "Pluronics", a product of BASF-Wyandotte Corporation.

Examples of other suitable surfactants include low-foaming anionics such as dodecyl hydrogen phosphate, methyl napthalene sulfonate, sodium 2-acetamido-hexadecane-1-sulfonate and mixtures thereof. Preferred anionics include materials selected from the class of branched alkali metal mono- and di-$C_8$–$C_{14}$ alkyl diphenyl oxide mono- and disulfonates and linear alkali metal mono- and di $C_{8-14}$ alkyl diphenyl oxide mono- and disulfonates. Mixtures of any of the foregoing surfactants or of surfactants from any of the enumerated categories may be used. If desired, anti-foaming agents may be utilized as well. Antifoaming agents typically include a hydrocarbon oil and/or a silicone oil or together with particles such as silica. Mono and distearyl acid phosphates are also preferred suds suppressors.

Autodish products in accordance with the invention may include enzymes, in particular, protease, amylase and/or lipase. Enzymes may be present at levels of from about 0.5 to 2% by weight, preferably from 0.5 to 1.5%, especially 0.5 to 1%.

The compositions of the invention may also include clays at a level of from 0.1 to 60%, preferably from 0.5% to 25%, and most preferably from 0.5% to 5% by weight.

Other ingredients which may be present in minor amounts include, perfumes, antiredeposition agents, suds builders, dyes, pigments, foam control agents, anti-tarnish agents, soil suspending agents, other functional additives, and fillers in addition to those mentioned above.

Laundry detergents according to the invention will include many of the same ingredients mentioned in connection with the autodish compositions, as will be apparent to one of ordinary skill in the art.

In general, the laundry detergents will include from 10 to 70% by weight of surfactants selected from the group consisting of anionic, nonionic, cationic, zwitterionic and amphoteric surfactants, and from 5 to 60% of the builders selected from the group consisting of a) non-silicate-coated inorganic tripolyphosphates hydrated in accordance with the present invention together with silicated alkali metal carbonate, bicarbonate or sesquicarbonate or silicated mixtures thereof with alkali metal sulfate or other nonphosphate, inorganic salts, (b) silicated inorganic alkali metal salt selected from the group of alkali metal and ammonium carbonate, bicarbonate and sesquicarbonate in accordance with the second aspects of the invention, and (c) mixtures of (a) and (b) with each other and/or with other builders such as inorganic phosphates not prepared in accordance with the invention, non-silicate-coated carbonates, crystalline and amorphous aluminosilicates, nitrilotriacetic acid and salts thereof, citric acid and salts thereof, and other builders mentioned above. Generally, the total of (a) and (b) above will range from 5 to 60%.

Enzymes, chlorine bleach, oxygen bleach, activators and catalysts, may be included in the amounts given above for autodish compositions. Other ingredients found in powdered laundry detergents may also be included.

In general, processes in accordance with the invention for making automatic dishwashing or other compositions, such as laundry detergent compositions, comprise dry mixing of a non- silicate-coated alkali metal inorganic phosphate, preferably hydrated in accordance with the first aspect of the invention, with a silicated inorganic salt, preferably having the moisture levels of and/or prepared in accordance with the process of the second aspects of the invention.

Typically, the alkali metal or ammonium tripolyphosphate salt, e.g., sodium tripolyphosphate, will be subjected first to hydration by spraying water thereon to achieve at least 50% by weight hydration, preferably at least 60%, especially at least 75%. Then the salt is agglomerated. The hydrated salt is subjected to conditioning, sizing, storage and then blending with a silicated inorganic salt, preferably one in accordance with the second aspects of the invention.

Parallel to the inorganic phosphate processing will occur the processing of the silicated salt or salts. First, the salt or salt mixture (e.g., sodium carbonate plus sodium sulfate) is sprayed with an aqueous silicate solution (e.g., sodium silicate) preferably having about 35 to about 50% solids. Preferably the solution has a temperature of from 40° to 70° C. Optionally, the spraying solution may also include surfactant and other ingredients. The salts are agglomerated in, for example a Schugi or O'Brien agglomerator. Rolling drum agglomerators in general and pan agglomerators may also be used. Then the agglomerate is conditioned by exposure to heated air, i.e., air heated to a temperature greater than 78° F. Generally, the salt is heated such that its moisture content is at least 5%, preferably 6%, especially 7.5%. Preferably, the air is at a temperature so that the silicated salt attains a temperature in the range of 120° to 150° F.

Powder temperatures of from 125° to 140° F. and treatment times of from 10 to 15 minutes are especially preferred. Ideally the agglomerate is exposed to the heated air for about 20 minutes. Preferably the conditioning occurs on a fluidized bed. An oven may also be used. However, in the case of oven heating, treatment occurs for from 15 minutes to 1 hour at an oven temperature of from 140° to 180° F. Preferably, treatment in the oven occurs at from 150° to 170° F. for from 20 to 40 minutes. 160° F. temperatures are preferred. After the conditioning, the agglomerated salt is sized, stored and then blended, preferably with the hydrated phosphate.

Unless otherwise indicated, all percentages given herein are by weight.

EXAMPLES

Example 1 - Phosphate Hydration

The effect of the level of phosphate hydration in compositions including phosphate and silicated soda ash was investigated using a Sears Kenmore Automatic Dishwasher. 1:1 mixtures (by weight) of silicated salt and sodium tripolyphosphate hydrated to various levels were used.

The silicated salt was prepared by placing the salt mixture in a Schugi agglomerator and spraying with aqueous silicate solution. Two batches were prepared and they had mean particle sizes of 675 microns and 1100 microns, respectively. The composition of the silicated ash mixture was as follows.

| | Parts | |
|---|---|---|
| | Ash A | Ash B |
| Soda ash (grade 100) | 30.0 | 30.0 |
| Sodium sulfate | 11.8 | 11.8 |
| Aqueous silicate 2.4 ratio (47.1% solids) | 19.11 | 19.11 |
| Particle size (microns) | 675 | 1100 |

An initial machine dishwashing test showed that the silicated ash mixture dispensed quite readily when tested alone. The rate of dispensing of the 1:1 mixture depended on the level of hydration of the phosphate. The product containing anhydrous phosphate showed a sizeable amount of residue in the cup at the end of the wash. When the level of phosphate hydration exceeded 60 percent, the product's dispensing was clearly acceptable. The results for mixtures with silicated ash A are given in Table IA and the results for silicated ash B are given in Table IB.

TABLE 1A

Dispenser Caking test
Silicated Ash and TPP Hydrate Mixtures

Silicated Ash - 10067 PP
TPP Hydrate - Monsanto Dense Lot 95
Mixture Wt. - 45–50 grams (1:1)

| Time (secs) % Hydration of TPP | % Product Removal After | | | | | | | |
|---|---|---|---|---|---|---|---|---|
| | 5 | 10 | 15 | 20 | 30 | 60 | 120 | End |
| 86 | 100 | — | — | — | — | — | — | — |
| 72 | 90 | 90 | 90 | 97 | 100 | — | — | — |
| 64 | 80 | 80 | 80 | 80 | 80 | 90 | 98 | 100 |
| 56 | 30 | 40 | 60 | 60 | 60 | 70 | 70 | 85 |
| 47 | 20 | 35 | 40 | 40 | 40 | 50 | 65 | 70 |
| 31 | 20 | 20 | 20 | 20 | 20 | 25 | 35 | 60 |
| 0 | 10 | 15 | 15 | 15 | 15 | 20 | 20 | 40 |

TPP denotes sodium tripolyphosphate.

TABLE 1B

Dispenser Caking Test
Silicated Ash & TPP Hydrate Mixtures

| Time (secs) Hydration of TPP | % Product Removal After | | | | | | | |
|---|---|---|---|---|---|---|---|---|
| | 5 | 10 | 15 | 20 | 30 | 60 | 120 | End |
| 86 | 90 | 95 | 95 | 98 | 98 | 100 | — | — |
| 72 | 80 | 85 | 95 | 97 | 99 | 100 | — | — |
| 63 | 50 | 55 | 60 | 65 | 70 | 95 | 100 | — |
| 56 | 30 | 35 | 45 | 55 | 55 | 95 | 97 | 100 |
| 47 | 25 | 35 | 50 | 60 | 70 | 75 | 85 | 100 |
| 31 | 35 | 35 | 35 | 35 | 35 | 40 | 50 | 80 |
| 0 | 5 | 20 | 20 | 30 | 30 | 35 | 35 | 65 |

Example 2-Fluid Bed Drying of Silicated Ash Mixtures Two samples of agglomerated silicated ash were prepared, one using a Schugi agglomerator (mean particle size of the particles equaled 1400 microns) and the other in the laboratory using a blender (675 micron particles resulted). The agglomerates were conditioned on an Aeromatic fluid bed. The moisture levels and solubilities of samples prepared at various temperatures were measured. The sample prepared using the Schugi agglomerator was initially conditioned whereas the laboratory samples were not, so the results are not quite comparable. The results are given in Tables 2A and 2B. Solubility is rated on a scale of 0 to 5, with 0 being no residue and 5 heavy residue. The data show that higher levels of insolubles are formed as the powder temperature and residence times are increased.

TABLE 2A

Fluid Bed Drying Expt.
Silicated Ash (Laboratory Samples)

| | Fluid Bed Cond. | | Powder Temp. | | % $H_2O$ via Loss at: | | |
|---|---|---|---|---|---|---|---|
| | Mins. | Setting | °C. | °F. | 70° C. | 135° C. | Sol. |
| 7L | 10 | 80 | 49 | 120 | 7.9 | 11.2 | 0 |
| | 20 | " | 52 | 126 | 5.2 | 8.7 | 0 |
| | 30 | " | 58 | 136 | 4.2 | 7.1 | 0 |
| | 45 | " | 60 | 140 | 2.2 | 5.2 | 0 |
| 7L-1 | 10 | 90 | 50 | 122 | 7.2 | 9.8 | 0 |
| | 20 | " | 58 | 137 | 4.4 | 6.8 | 0 |
| | 30 | " | 65 | 149 | 2.8 | 5.3 | 0.25 |
| | 45 | " | 65 | 149 | 1.8 | 3.7 | 2 |
| | 60 | " | 70 | 158 | 1.0 | 2.8 | 2.5 |
| 7L-1 | 10 | 100 | 56 | 133 | 6.7 | 9.0 | 0 |
| | 20 | " | 62 | 144 | 3.5 | 5.2 | 0.5 |
| | 30 | " | 70 | 158 | 1.7 | 5.2 | 1.5 |
| | 45 | " | 70 | 158 | 0.7 | 2.3 | 3 |
| | 60 | " | 70 | 158 | 0.3 | 1.8 | 4 |

Product weight = 1 kg
The readings at 70° C. and 135° C. are taken as indications of the amounts of free and total moisture, respectively.
Solubility: 0 = No residue, 5 = Heavy residue

TABLE 2B

Fluid Bed Drying Expt.
Silicated Ash (Schugi Samples)

| | Fluid Bed Cond. | | Powder Temp. | | $H_2O$ via Loss at: | | |
|---|---|---|---|---|---|---|---|
| Code | Mins. | Setting | °C. | °F. | 70° C. | 135° C. | Sol. |
| 10067PP | 10 | 60 | 44 | 112 | 8.2 | 12.9 | 0 |
| | 20 | 60 | 50 | 122 | 7.8 | 12.3 | 0 |
| | 60 | 60 | 50 | 122 | 7.2 | 10.3 | 0 |
| | 10 | 80 | 56 | 133 | 8.6 | 12.6 | 0 |
| | 20 | 80 | 58 | 137 | 7.2 | 10.8 | 1 |
| | 60 | 80 | 60 | 140 | 3.0 | 6.0 | 2–3 |
| | 5 | 100 | 52 | 126 | 7.2 | 12.6 | 0–1 |
| | 10 | 100 | 60 | 140 | 6.5 | 11.6 | 1 |
| | 15 | 100 | 62 | 144 | 5.0 | 10.3 | 1–2 |
| | 20 | 100 | 62 | 144 | 4.7 | 9.4 | 2–3 |
| | 30 | 100 | 70 | 158 | 4.0 | 7.2 | 2–3 |

Product Wt. = 1 kg
Initial $H_2O$ Loss @ 70° C. = 10.0
Loss @ 135° C. = 14.0

Example 3 - Oven Drying

Silicated ash samples which were conditioned via the oven method showed similar results to the samples that were conditioned using the fluid bed method, i.e., higher levels of insolubles were formed then the powder temperature and residence time were increased. The results are given in Table 3.

TABLE 3

| | | | | Parts |
|---|---|---|---|---|
| Composition | Soda Ash (Grade 100) | | | |
| | Sodium Sulfate | | | 12 |
| | Ru Silicate 2.4 r (47.1% by weight solids) | | | 21.23 |
| Oven Drying Data | | | | |
| Oven Temp. (°C./°F.) | 70/158 | 100/212 | 135/275 | |
| Initial $H_2O$ (K. F.) | 11.7 | 11.7 | 11.7 | |
| % $H_2O$/Solubility After | | | | |
| 15 mins. | — | — | 1.0–2.25 | |

TABLE 3-continued

| | | | |
|---|---|---|---|
| 30 mins. | 8.1–0 | 3.0–0.25 | 0.7–3.0 |
| 60 mins. | 7.2–0.25 | 1.6– — | 0.4–3.5 |
| 90 mins. | 5.4–1.0 | 1.1–3.0 | — –5.5 |
| 2 hrs. | 3.9–2.0 | 1.0– — | — |
| 3.25 hrs. | 3.2–5.0 | — –3.25 | — |

K. F. denotes Karl Fisher moisture analysis

Example 4

The automatic dishwashing composition of Table 4 was blended using premixes of silicated soda ash and STPP which is hydrated to greater than 80% by weight. The silicated soda ash premix was prepared with a Schugi agglomerator while the hydrated STPP premix was prepared with a continuous O'Brien agglomerator. Nonionic was post added to the STPP premix. After six months of storage the product and two premixes showed excellent solubility ratings even for the high temperature conditions. These results were surprisingly better than typical storage data obtained on currently marketed products Storage data are given in Table 5. Typical storage results for a currently marketed automatic dishwasher detergent (ADD) made via agglomeration are shown in Table 6.

TABLE 4

"Dry Blended" Formulation - ADD 0149

| | | |
|---|---|---|
| Soda Ash | 20.0 | AGG 37 (Soda Ash Premix A) |
| Sodium Sulfate | 25.5 | |
| Ru silicate, 2.4 r (47.1% solids) | 9.0 | |
| STPP (granular) | 32.0 | Phosphate Premix B |
| Nonionic | 2.5 | |
| Water | 11.0 | |

TABLE 5

Storage Data for Formulation of Table 4 and Premixes

| | | 8.1 P Finished Product | | Phosphate Premix B | | Soda Ash Premix (A) | |
|---|---|---|---|---|---|---|---|
| | | Initial values | | | | | |
| Solubility | | 0 | | 0–1/0 | | 0 | |
| Storage | | Sol. | Flow | Sol. | Flow | Sol. | Flow |
| 2 | RT | 0 | ff | 0 | ff | 0 | ff |
| Weeks | 80/80 | 0 | " | 0 | " | 0 | " |
| | 95/50 | 0 | " | 0 | " | — | — |
| | 125° F. | 0 | " | 0 | " | 0 | fr. ck. |
| 1 | RT | 0 | ff | 0 | ff | 0 | ff |
| Month | 80/80 | 0 | " | 0–1 | " | 0 | " |
| | 95/50 | 0 | " | 0 | " | — | — |
| | 125° F. | 0 | " | 0 | " | 0–1 | fr. ck. |
| 2 | RT | 0 | ff | 0 | ff | 0 | ff |
| Months | 80/80 | 0 | " | 1–2/1 | " | 0 | fr. ck. (½ pkg) |
| | 95/50 | 0 | " | 0 | " | — | — |
| | 125° F. | 0 | ¼ box fr. ck. | 0 | " | 0 | fr. ck. |
| 3 | RT | 0 | ff | 0 | ff | 0 | ff |
| Months | 80/80 | 0 | " | 0 | " | 0 | fr. ck. (½ pkg) |
| | 95/50 | 0 | " | 0 | " | — | — |
| | 125° F. | 1 | " | 1 | " | 0 | fr. ck. |
| 6 | RT | 0 | ff | 0 | ff | 0 | fr. ck. |
| Months | 80/80 | 0 | " | 0 | " | 0 | " |
| | 95/50 | 0 | " | 0–1 | " | — | — |
| | 125° F. | 1–2 | " | 0–1 | " | 0 | — |

RT = room temperature
[a]ff = free flowing
[b]fr. ck. = friable caking

TABLE 6

Storage Data for Currently Marketed Product

| | | |
|---|---|---|
| Initial Solubility | | 2–3/3 |
| Solubility After | | |
| 2 Months - | RT | 3 |
| | 80/80 | 3–4 |
| | 95/50 | 3–4 |
| | 125° F. | 4 |
| 3 Months - | RT | 3 |
| | 80/80 | 3 |
| | 95/50 | 3 |

TABLE 6-continued

It should be understood that the specific forms of the invention herein illustrated and described are intended to be representative only, as certain changes may be made without departing from the teachings of the disclosure. Accordingly, reference should be made to the following appended claims in determining the full scope of the invention.

We claim:

1. A composition comprising (a) at least 10% by weight of a non-silicate-coated alkali metal or ammonium tripolyphosphate salt hydrated to at least about 50% by weight, and (b) at least 10% by weight of an inorganic salt selected from the group consisting of (i) alkali metal and ammonium carbonate, bicarbonate and sesquicarbonate and mixtures and (ii) mixtures thereof with alkali metal and ammonia chloride or sulfate at a weight ratio of from 10:1 to !:10 wherein the inorganic salt is prepared by admixing with aqueous alkali metal silicate liquid;

wherein compound (a) and compound (b) are separately prepared.

2. The composition of claim 1 wherein the weight ratio. Of silicated inorganic salt to phosphate salt hydrated to at least 50% is about 70:30 or less.

3. The composition of claim 1 wherein the alkali metal phosphate sale is sodium tripolyphosphate.

4. The composition of claim 1 wherein the alkali metal carbonate is sodium carbonate.

5. The composition of claim 1 wherein the alkali metal sulfate is sodium sulfate.

6. The composition of claim 1 wherein the alkali metal silicate is sodium silicate.

7. The composition of claim 1 wherein the alkali metal tripolyphosphate is hydrated to at least 60% by weight.

8. The composition of claim 1 wherein the alkali metal tripolyphosphate is hydrated to at least 75% by weight.

9. The composition of claim 1 further comprising from 0.5 to 70% by weight of a surfactant selected from the group consisting of anionic, nonionic, cationic, zwitterionic and amphoteric surfactants and mixtures thereof.

10. A process for preparing a non-phosphate, inorganic carbonate, bicarbonate or sesquicarbonate salt agglomerated with aqueous alkali metal silicate solution which comprises:

(a) in the substantial absence of phosphate salts, admixing the non-phosphate inorganic salt with an alkali metal silicate solution having a temperature within the range of 104° F. to 158° F., and (b) conditioning the silicated salt with heated air so that the silicated salt has a moisture content by weight of at least 5%.

11. The process of claim 10 wherein the silicated salt is exposed to heated air so that the silicated salt has a moisture content by weight of at least 6%.

12. The process of claim 11 wherein the silicated salt is exposed to heated air so that the silicated salt has a moisture content by weight of at least 7.5%.

13. Process of claim 12 wherein the silicated salt is conditioned such that the silicated salt has moisture content of no greater than 12% by weight.

14. Process of claim 10 wherein the silicated salt is conditioned such that is has a moisture content of no greater than 12% by weight.

15. The process of claim 10 wherein the salt is alkali metal carbonate.

16. The process of claim 15 wherein the alkali metal carbonate is admixed with alkali-metal sulphate.

17. The process according to claim 10 wherein the inorganic salt is conditioned on a fluidized bed.

18. The silicated inorganic salt made by the process of claim 10.

19. A process for preparing a non-phosphate inorganic salt agglomerated with alkali metal silicate which comprises:

(a) in the substantial absence of phosphate salts, admixing a non-phosphate inorganic salt selected from the group consisting of alkali metal or ammonium carbonate, bicarbonate or sesquicarbonate with an aqueous solution of alkali metal silicate and (b) conditioning the silicated salt by exposure to air heated air for a period of from 5 to 25 minutes such that the temperature of the powder reaches at least 120° F. and does not exceed 150° F. during the period.

20. The process of claim 19 wherein a temperature of the silicated salt of within the range of between 125° and 140° F. is reached during the period.

21. The process of claim 20 wherein temperature of the silicated salt reaches approximately 140° F. and the silicated salt is exposed to the heated air for approximately 20 minutes.

22. The process of claim 19 wherein the salt is alkali metal carbonate.

23. The process of claim 22 wherein the alkali metal carbonate is admixed with alkali-metal sulphate.

24. The process according to claim 19 wherein the inorganic salt is conditioned on a fluidized bed.

25. A composition comprising (a) at least 10% by weight of a non-silicate treated alkali-metal tripolyphosphate salt hydrated to at least 50% by weight, and (b) at least 10% of a silicated non-phosphate inorganic salt selected from the group consisting of alkali-metal and ammonium carbonates, bicarbonates, and sesquicarbonates and mixtures thereof having a moisture content of at least 5%, wherein compound (a) and compound (b) are separately prepared.

26. The composition of claim 25 wherein the silicated inorganic salt has a moisture content of at least 6%.

27. The composition of claim 25 wherein the silicated inorganic salt has a moisture content of at least 7.5%.

28. The composition of claim 25 wherein the alkali metal phosphate salt is a tripolyphosphate.

29. The composition of claim 25 wherein the inorganic salt is alkali-metal carbonate is admixed with alkali-metal sulphate.

30. The composition of claim 25 wherein the phosphate is hydrated to at least 60% by weight.

31. The composition of claim 25 wherein the phosphate is hydrated to at least 75% by weight.

32. The composition of claim 25 wherein the weight ratio of silicated salt to hydrated phosphate is not greater than 70:30.

33. The composition of claim 25 further comprising from 0.5–70% by weight of a surfactant selected from the group consisting of anionic, nonionic, cationic, amphoteric and zwitterionic surfactants and mixtures thereof.

34. The process according to claim 25 wherein the silicated salt is conditioned such that it has a moisture content of not greater than 12% by weight.

35. A composition comprising (a) at least 10% by weight of a non-silicate-treated alkali metal or ammonium tripolyphosphate salt hydrated to at least 50% by weight, and (b) at least 10% by weight of a silicated inorganic non-phosphate salt, wherein the salt is selected from the group consisting of alkali metal or ammonium carbonate, bicarbonate and sesquicarbonate, or a mixture thereof or from a mixture of one of said alkali metal or ammonium carbonate salts or a mixture thereof and (i) an alkali metal or ammonium sulfate; (ii) an alkali metal or ammonium chloride; or (iii) borax;

said inorganic non-phosphate salt being prepared by (A) agglomerating the inorganic salt with an aqueous sodium silicate solution and (B) conditioning the resulting agglomerate by exposure to heated air for a period of from 5 to 25 minutes and that the powder temperature reaches at least 120° F. but does not exceed 150° F. during that period.

36. The composition of claim 35 wherein the agglomerate reaches a powder temperature within the range of from 125° to 140° F. during the period.

37. The composition of claim 36 wherein the agglomerate is exposed to the heated air for about 20 minutes.

38. The composition of claim 35 wherein the phosphate salt is an alkali metal or ammonium tripolyphosphate and is hydrated to at least 60% by weight.

39. The composition of claim 35 wherein the phosphate salt is hydrated to at least 75% by weight.

40. The composition of claim 35 wherein the inorganic salt is selected from the group consisting of alkali metal carbonates and mixtures thereof with alkali metal sulfates.

41. The composition of claim 35 further comprising from 0.5 to 70% by weight of a surfactant selected from the group consisting of anionic, nonionic, cationic, zwitterionic and amphoteric surfactants and mixtures thereof.

42. The composition of claim 35 wherein the inorganic salt is conditioned on a fluidized bed.

43. A composition comprising (a) at least 10% by weight of a non-silicate treated inorganic alkali metal phosphate salt which is hydrated to at least 50% by weight, and (b) at least 10% by weight of a silicated inorganic non-phosphate salt, wherein the salt is selected from the group consisting of alkali metal or ammonium carbonate, bicarbonate and sesquicarbonate or a mixture thereof or from a mixture of one of said alkali metal or ammonium carbonate salts or a mixture thereof and (i) an alkali metal or ammonium sulfate;

(ii) an alkali metal or ammonium chloride; or (iii) borax;

said inorganic non-phosphate salt being prepared by (A) agglomerating the inorganic salt with an aqueous sodium silicate solution, and (B) conditioning the resulting agglomerate by heating in an oven for a period of 15 minutes to an hour such that the oven temperature reaches at least 140° F. and does not exceed 180° F. during that period.

44. The composition of claim 43 wherein the temperature reaches 150° F. and does not exceed 170° F. and the period is from 20 to 40 minutes.

45. Process of preparing a silicated inorganic salt comprising:

(a) in the substantial absence of phosphate salts, admixing a non-phosphate, inorganic salt selected from the group consisting of alkali metal and ammonium carbonate, bicarbonate and sesquicarbonates with an alkali metal silicate solution having a temperature within the range of 104° F. to 158° F., and (b) conditioning the silicated salt by heating in an oven for from 15 minutes to one hour so that the oven temperature reaches at least 140° F. but does not exceed 180° F.

* * * * *